US011270571B1

(12) United States Patent
Hansen et al.

(10) Patent No.: US 11,270,571 B1
(45) Date of Patent: Mar. 8, 2022

(54) SANITARY ENFORCEMENT ACTION FOR DEVICE

(71) Applicant: Lenovo (Singapore) Pte. Ltd., Singapore (SG)

(72) Inventors: Andrew David Hansen, Raleigh, NC (US); Russell Speight VanBlon, Raleigh, NC (US); Girishpurushottam Hoogar, Apex, NC (US)

(73) Assignee: Lenovo (Singapore) Pte. Ltd., Singapore (SG)

( * ) Notice: Subject to any disclaimer, the term of this patent is extended or adjusted under 35 U.S.C. 154(b) by 0 days.

(21) Appl. No.: 17/203,136

(22) Filed: Mar. 16, 2021

(51) Int. Cl.
*G08B 21/18* (2006.01)
*G08B 21/24* (2006.01)

(52) U.S. Cl.
CPC ..... *G08B 21/245* (2013.01)

(58) Field of Classification Search
CPC ..... G08B 21/245; A61B 19/34; A61B 7/02; G06N 20/00
See application file for complete search history.

(56) References Cited

U.S. PATENT DOCUMENTS

| | | | | |
|---|---|---|---|---|
| 10,235,861 | B1 * | 3/2019 | Burns | G16H 40/63 |
| 10,818,157 | B1 * | 10/2020 | Koester | B05B 12/122 |
| 11,017,321 | B1 * | 5/2021 | Mishra | G05B 23/0283 |
| 2006/0243762 | A1 * | 11/2006 | Sassoon | B65D 83/262 222/649 |
| 2014/0297371 | A1 * | 10/2014 | Colburn | G07C 1/10 705/7.38 |
| 2015/0182647 | A1 * | 7/2015 | Ranta | A61L 2/10 250/338.1 |
| 2016/0089214 | A1 * | 3/2016 | Schonfeld | A61L 2/00 134/18 |
| 2018/0060700 | A1 * | 3/2018 | Bleyer | H04N 5/2256 |
| 2020/0250956 | A1 * | 8/2020 | Hayes | G16H 40/20 |
| 2021/0074436 | A1 * | 3/2021 | Trim | A47L 9/2852 |
| 2021/0128762 | A1 * | 5/2021 | LaPorte | A61L 2/24 |

* cited by examiner

*Primary Examiner* — An T Nguyen
(74) *Attorney, Agent, or Firm* — Ference & Associates LLC

(57) ABSTRACT

One embodiment provides a method, including: receiving, at an information handling device, an indication that an activity session has ended; determining, using a sensor, whether one or more user contact portions of the information handling device were cleaned after the indication was received; and performing, responsive to determining that the one or more user contact portions were not cleaned, a sanitary enforcement action. Other aspects are described and claimed.

18 Claims, 3 Drawing Sheets

SANITARY ENFORCEMENT ACTION FOR DEVICE

BACKGROUND

As technology progresses, an increased number of information handling devices ("devices"), for example wearable devices such as head mounted displays ("HMDs"), have augmented reality ("AR") and/or virtual reality ("VR") capabilities. Users may leverage the functionality of these wearable devices to enrich their interactions with digital content. Additionally, advances in this space have led to the incorporation of AR and/or VR into many practical applications in business, recreation, education, healthcare, and many other fields.

BRIEF SUMMARY

In summary, one aspect provides a method, including: receiving, at an information handling device, an indication that an activity session has ended; determining, using a sensor, whether one or more user contact portions of the information handling device were cleaned after the indication was received; and performing, responsive to determining that the one or more user contact portions were not cleaned, a sanitary enforcement action.

Another aspect provides an information handling device, including: a sensor; a display screen; a processor; a memory device that stores instructions executable by the processor to: receive an indication that an activity session has ended; determine whether one or more user contact portions of the information handling device were cleaned after the indication was received; and perform, responsive to determining that the one or more user contact portions were not cleaned, a sanitary enforcement action.

A further aspect provides a product, including: a storage device that stores code, the code being executable by a processor and comprising: code that receives an indication that an activity session has ended on an information handling device; code that determines whether one or more user contact portions of the information handling device were cleaned after the indication was received; and code that performs, responsive to determining that the one or more user contact portions were not cleaned, a sanitary enforcement action.

The foregoing is a summary and thus may contain simplifications, generalizations, and omissions of detail; consequently, those skilled in the art will appreciate that the summary is illustrative only and is not intended to be in any way limiting.

For a better understanding of the embodiments, together with other and further features and advantages thereof, reference is made to the following description, taken in conjunction with the accompanying drawings. The scope of the invention will be pointed out in the appended claims.

DETAILED DESCRIPTION

Figure 1:
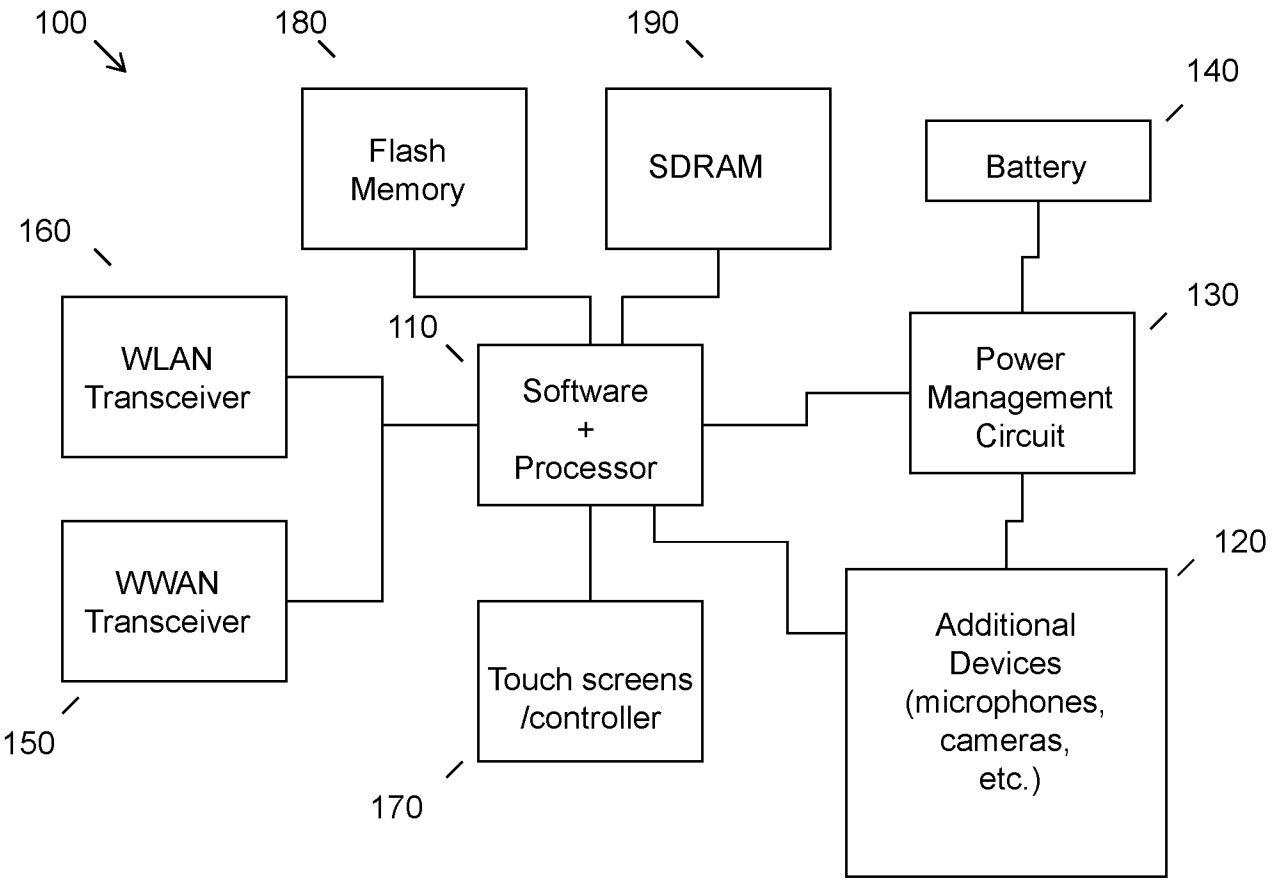
FIG. 1 illustrates an example of information handling device circuitry.

It will be readily understood that the components of the embodiments, as generally described and illustrated in the figures herein, may be arranged and designed in a wide variety of different configurations in addition to the described example embodiments. Thus, the following more detailed description of the example embodiments, as represented in the figures, is not intended to limit the scope of the embodiments, as claimed, but is merely representative of example embodiments.

Reference throughout this specification to "one embodiment" or "an embodiment" (or the like) means that a particular feature, structure, or characteristic described in connection with the embodiment is included in at least one embodiment. Thus, the appearance of the phrases "in one embodiment" or "in an embodiment" or the like in various places throughout this specification are not necessarily all referring to the same embodiment.

Furthermore, the described features, structures, or characteristics may be combined in any suitable manner in one or more embodiments. In the following description, numerous specific details are provided to give a thorough understanding of embodiments. One skilled in the relevant art will recognize, however, that the various embodiments can be practiced without one or more of the specific details, or with other methods, components, materials, et cetera. In other instances, well known structures, materials, or operations are not shown or described in detail to avoid obfuscation.

It is not uncommon for a multitude of individuals to use and interact with a single device. For example, display models are often presented in electronic stores or trade shows to demonstrate the capabilities of a new product. Individuals may take turns handling the display model to examine the features that the new product may have. In another example, a company may have a limited number of devices that their employees must share to complete various tasks. More particularly, employees on the same shift may need to share devices with one another or, alternatively, an employee working on one shift must hand off the device to another employee working on a later shift.

Due to the high handling volume, users of shared devices are at an increased risk of catching and spreading germs. Conventionally, efforts to maintain sanitary conditions for shared devices are established by each device-owning entity (e.g., each company, each organization, each group, etc.). More particularly, each entity may have their own device cleaning protocols as well as enforcement procedures when non-compliance is identified. For example, a company during a showcase may provide signage that requests users to clean a device after they are finished interacting with it. The signage may also include warnings that indicate potential punishment for cleaning protocols violators (e.g., violators may be prevented from using the shared device any longer, etc.).

Situations often arise when users do not comply with the aforementioned protocols. For example, some users may be unaware that a particular cleaning protocol exists or may simply choose to ignore it. Accordingly, existing solutions rely on human intervention to enforce these protocols. For example, dedicated personnel may be hired to monitor the equipment and ensure that the cleanliness standards are maintained. However, these personnel come at an additional cost and may still not guarantee that each shared device is cleaned before a subsequent use. For example, the personnel may overlook or forget to clean a particular device, which may happen relatively frequently in situations where there are many more device users than there are personnel (e.g., in a store, etc.).

Accordingly, an embodiment provides a method that can monitor when a device has been cleaned and can also dynamically implement a sanitary enforcement action responsive to determining that it hasn't. In an embodiment, an indication may be received at a device (e.g., an HMD, another wearable device, etc.) that an activity session has ended. An embodiment may then determine whether one or more user contact portions on the device were cleaned have user. Responsive to determining that the user contact portion(s) were not cleaned, an embodiment may thereafter perform a type of sanitary enforcement action, as further elaborated upon herein. Such a method may ensure that devices remain clean and sanitary for user use.

The illustrated example embodiments will be best understood by reference to the figures. The following description is intended only by way of example, and simply illustrates certain example embodiments.

While various other circuits, circuitry or components may be utilized in information handling devices, with regard to smart phone and/or tablet circuitry 100, an example illustrated in FIG. 1 includes a system on a chip design found for example in tablet or other mobile computing platforms. Software and processor(s) are combined in a single chip 110. Processors comprise internal arithmetic units, registers, cache memory, busses, I/O ports, etc., as is well known in the art. Internal busses and the like depend on different vendors, but essentially all the peripheral devices (120) may attach to a single chip 110. The circuitry 100 combines the processor, memory control, and I/O controller hub all into a single chip 110. Also, systems 100 of this type do not typically use SATA or PCI or LPC. Common interfaces, for example, include SDIO and I2C.

There are power management chip(s) 130, e.g., a battery management unit, BMU, which manage power as supplied, for example, via a rechargeable battery 140, which may be recharged by a connection to a power source (not shown). In at least one design, a single chip, such as 110, is used to supply BIOS like functionality and DRAM memory.

System 100 typically includes one or more of a WWAN transceiver 150 and a WLAN transceiver 160 for connecting to various networks, such as telecommunications networks and wireless Internet devices, e.g., access points. Additionally, devices 120 are commonly included, e.g., an image sensor such as a camera, audio capture device such as a microphone, etc. System 100 often includes one or more touch screens 170 for data input and display/rendering. System 100 also typically includes various memory devices, for example flash memory 180 and SDRAM 190.

Figure 2:
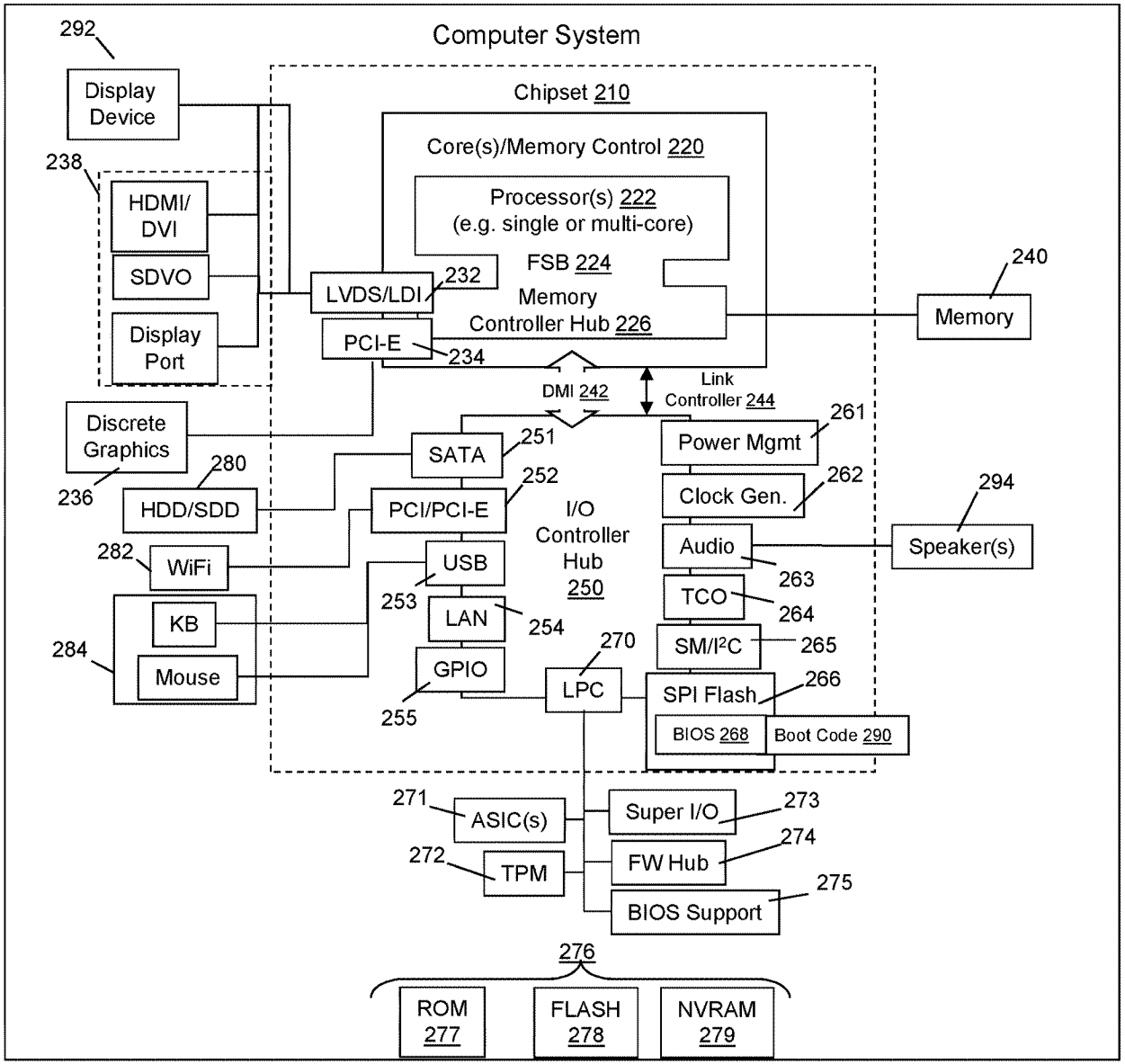
FIG. 2 illustrates another example of information handling device circuitry.

FIG. 2 depicts a block diagram of another example of information handling device circuits, circuitry or components. The example depicted in FIG. 2 may correspond to computing systems such as the THINKPAD series of personal computers sold by Lenovo (US) Inc. of Morrisville, N.C., or other devices. As is apparent from the description herein, embodiments may include other features or only some of the features of the example illustrated in FIG. 2.

The example of FIG. 2 includes a so-called chipset 210 (a group of integrated circuits, or chips, that work together, chipsets) with an architecture that may vary depending on manufacturer (for example, INTEL, AMD, ARM, etc.). INTEL is a registered trademark of Intel Corporation in the United States and other countries. AMD is a registered trademark of Advanced Micro Devices, Inc. in the United States and other countries. ARM is an unregistered trademark of ARM Holdings plc in the United States and other countries. The architecture of the chipset 210 includes a core and memory control group 220 and an I/O controller hub 250 that exchanges information (for example, data, signals, commands, etc.) via a direct management interface (DMI) 242 or a link controller 244. In FIG. 2, the DMI 242 is a chip-to-chip interface (sometimes referred to as being a link between a "northbridge" and a "southbridge"). The core and memory control group 220 include one or more processors 222 (for example, single or multi-core) and a memory controller hub 226 that exchange information via a front side bus (FSB) 224; noting that components of the group 220 may be integrated in a chip that supplants the conventional "northbridge" style architecture. One or more processors 222 comprise internal arithmetic units, registers, cache memory, busses, I/O ports, etc., as is well known in the art.

In FIG. 2, the memory controller hub 226 interfaces with memory 240 (for example, to provide support for a type of RAM that may be referred to as "system memory" or "memory"). The memory controller hub 226 further includes a low voltage differential signaling (LVDS) interface 232 for a display device 292 (for example, a CRT, a flat panel, touch screen, etc.). A block 238 includes some technologies that may be supported via the LVDS interface 232 (for example, serial digital video, HDMI/DVI, display port). The memory controller hub 226 also includes a PCI-express interface (PCI-E) 234 that may support discrete graphics 236.

In FIG. 2, the I/O hub controller 250 includes a SATA interface 251 (for example, for HDDs, SDDs, etc., 280), a PCI-E interface 252 (for example, for wireless connections 282), a USB interface 253 (for example, for devices 284 such as a digitizer, keyboard, mice, cameras, phones, microphones, storage, other connected devices, etc.), a network interface 254 (for example, LAN), a GPIO interface 255, a LPC interface 270 (for ASICs 271, a TPM 272, a super I/O 273, a firmware hub 274, BIOS support 275 as well as various types of memory 276 such as ROM 277, Flash 278, and NVRAM 279), a power management interface 261, a clock generator interface 262, an audio interface 263 (for example, for speakers 294), a TCO interface 264, a system management bus interface 265, and SPI Flash 266, which can include BIOS 268 and boot code 290. The I/O hub controller 250 may include gigabit Ethernet support.

The system, upon power on, may be configured to execute boot code 290 for the BIOS 268, as stored within the SPI Flash 266, and thereafter processes data under the control of one or more operating systems and application software (for example, stored in system memory 240). An operating system may be stored in any of a variety of locations and accessed, for example, according to instructions of the BIOS 268. As described herein, a device may include fewer or more features than shown in the system of FIG. 2.

Information handling device circuitry, as for example outlined in FIG. 1 or FIG. 2, may be used in devices capable of displaying augmented reality content. For example, the circuitry outlined in FIG. 1 may be implemented in a wearable headset embodiment, whereas the circuitry outlined in FIG. 2 may be implemented in a smart phone or tablet.

Figure 3:
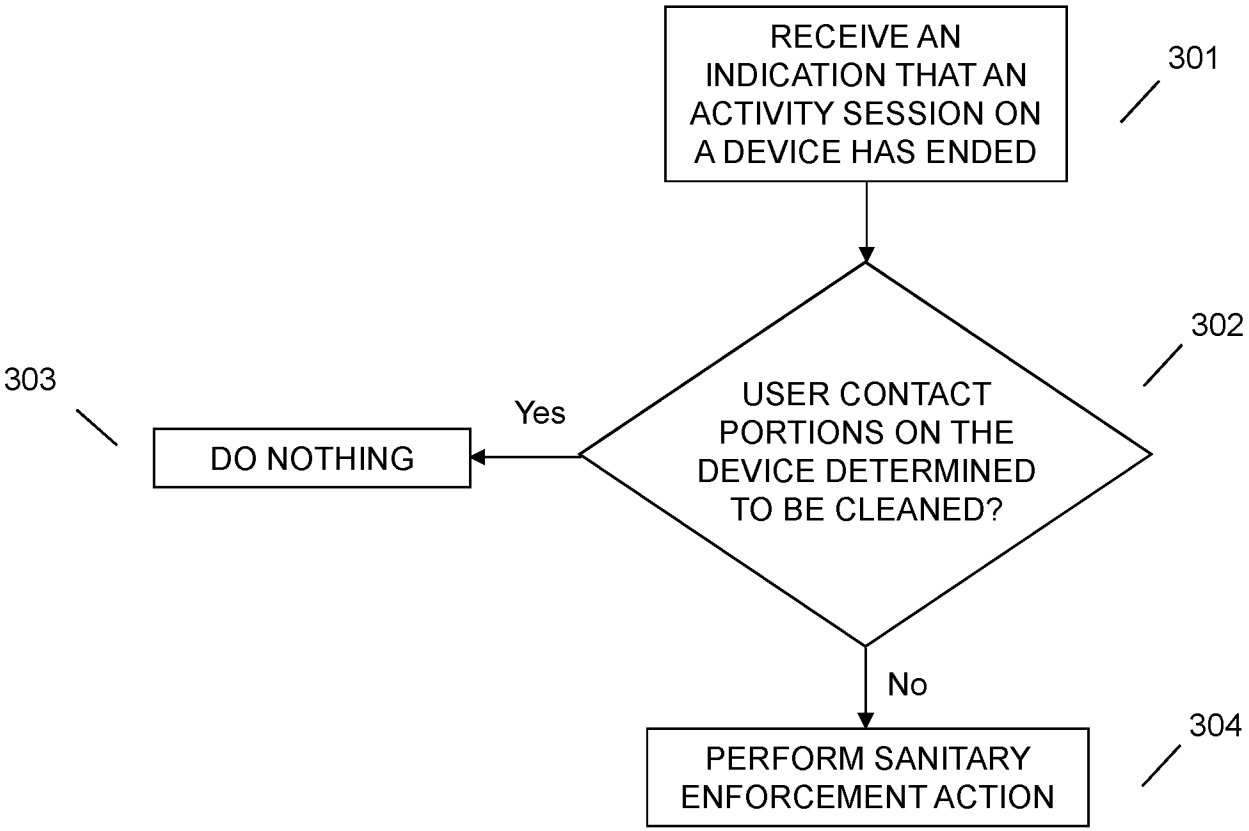
FIG. 3 illustrates an example method of dynamically performing a sanitary enforcement action.

Referring now to FIG. 3, a method for dynamically performing a sanitary enforcement action is provided. At 301, an embodiment may receive an indication on a device that an activity session has ended. Although the concepts described throughout this application may be applicable to many types of electronic devices, for simplicity purposes, the device described herein corresponds to a wearable headset that has AR and/or VR capabilities. It is important to note, however, that such a designation is not limiting.

In an embodiment, the indication that a session has concluded may originate from a determination that a user has removed the device from their person. An embodiment may facilitate this determination by leveraging one or more sensors (e.g., proximity sensors, camera sensors, gyroscopic sensors, etc.) integrated into the device. An embodiment may also access available context data to receive additional confirmation that the removal of the device aligns with a user's intention to conclude a session rather than just an inadvertent or temporary device removal (e.g., to readjust the device on the user's head, to momentarily step away from the device, etc.). For example, an embodiment may monitor user activity data to identify if they have performed one or more "shut down" actions prior to removing their device (e.g., closing out of an active application, logging out of an active application, etc.). As another example, an embodiment may access user calendar data, if available, to identify that a user's allotted interaction time with a device has concluded or that they have another scheduled appointment at substantially the time they removed the device. Both of the aforementioned context data types may provide the system with additional confidence that the user has concluded their session with the device.

At 302, an embodiment may determine whether one or more user contact portions of the device were cleaned after the indication was received. In the context of this application, a user contact position may refer to virtually any portion of the device that a user may contact with their body (e.g., with their head, face, hands, etc.). For example, the user contact position may refer to a display screen of the device, the bezel of the device, another surface of the device (e.g., a front surface, a back surface, etc.), and the like. The determination of whether the user contact positions have been cleaned may be facilitated in one or more different ways, as further described herein.

In an embodiment, the device may determine that the relevant device portions have been cleaned responsive to receiving a user confirmation input of the same. More particularly, subsequent to identifying that the device has been removed and/or that a session has ended, as previously described above, an embodiment may provide an alert notification to a user (e.g., using one or more integrated output devices such as a speaker, display screen, etc.). The alert notification may include a reminder that the device needs to be cleaned and may also include a prompt instructing the user to indicate to the device when it has done so (e.g., via an audible input, another type of non-touch confirmation input, etc.). Additionally or alternatively, the alert notification may specify exactly which portions of the device should be cleaned. If no confirmation input is received by the device, an embodiment may conclude that a cleaning event has not occurred.

In another embodiment, the device may take a more active role in the cleaning determination process. More particularly, an embodiment may leverage one or more different sensors (e.g., image sensors, moisture sensors, etc.) to dynamically determine whether cleaning has occurred. For example, an embodiment may require that one or more cameras on the front of the device (e.g., fisheye cameras, etc.) must detect that at least one swiping motion has occurred. More particularly, an embodiment must detect that each of the one or more cameras has been covered and subsequently uncovered in a short period of time (e.g., in 500 milliseconds or less, etc.). This action equates to the real-world act of wiping a display screen with a cloth. Additionally or alternatively, a moisture sensor installed on the device unit may be capable of detecting when a cleaning solution has been applied. Responsive to detecting moisture on a relevant device portion, an embodiment may conclude that it has been cleaned. Additionally or alternatively, a device may monitor for the occurrence of a refraction event. More particularly, when a camera lens is wiped with a cleaning solution, the sensors within may be able to register a rainbow effect due to light refracting through the moisture over the lens. Responsive to detecting such an effect, an embodiment may conclude that the device has been cleaned.

In certain implementations, a device may utilize a combination of user confirmation input and sensor data to determine whether a cleaning event has occurred. For example, if a user provides confirmation that they have cleaned the device but if the device does not register that a swiping motion has occurred, an embodiment may inform the user that the device is not yet clean. Additionally or alternatively, an embodiment may inform the user about which specific portion of the device is not clean and/or may further instruct the user how to properly clean that portion so that the device sensors can accurately register that a cleaning event has occurred.

Responsive to determining, at 302, that the one or more user contact portions of the device were cleaned, an embodiment may, at 303, take no additional action. Alternatively, an embodiment may record, in a database, that the previous user has cleaned the device. Additionally or alternatively, responsive to identifying that a new user is using the device, an embodiment may provide that new user with a notification indicating that the device has been cleaned and is ready for use. Conversely, responsive to determining, at 302, that the one or more user contact portions of the device were not cleaned, an embodiment may, at 304, perform a sanitary enforcement action. As used herein, a sanitary enforcement action corresponds to a dynamic action, taken by the device, to ensure that the device remains sanitary and/or to limit the potential for the spread of germs from uncleaned devices.

In an embodiment, the sanitary enforcement action may be an alert notification, provided to a new user of the device, that one or more portions of the device have not been cleaned. An embodiment may identify that a new user is about to use the device, or that a new activity session is about to be initiated on the device, by detecting device motion from an integrated inertial measurement unit ("IMU"). Responsive to detecting motion (i.e., after being positioned in a static position), an embodiment may conclude that the device is being moved and may subsequently provide the alert notification to the new user (e.g., using one or more output devices such as an integrated speaker, display screen, a combination thereof, and the like).

In another embodiment, the sanitary enforcement action may correspond to a content restriction action performed by the device. More particularly, the device may lock down its system and prevent access to content until the device receives an indication that the relevant device portions have been cleaned. Additionally or alternatively, in a similar embodiment, a device may restrict adjustment of a body attachment component as part of the sanitary enforcement action. For example, if a wearable headset contains an adjustable strap (i.e., used to comfortably secure the headset in place against the user's head), an embodiment may lock the strap at its tightest setting (i.e., too tight for a user to wear) until an indication is received that the relevant device portions have been cleaned.

Additionally or alternatively to the foregoing, the sanitary enforcement action may further involve recording statistics associated with device cleaning. For example, the system may keep track of: the number of successful cleanings in a predetermined time period, the number of attempted usages without cleanings, the identity of individuals that have failed to clean the device, and the like. A supervising authority may thereafter utilize these statistics to enrich their cleaning protocols and/or to levy punishments for cleaning violations. As a non-limiting, practical example of the latter, the device system may log a strike against an employee each time they have failed to clean a particular device after use. If a repeat violator is identified (i.e., an employee who has failed to clean the device a predetermined number of times), the system may provide an indication of these violations to an enforcement authority who may thereafter take some action against the employee (e.g., lecture the employee, sanction the employee in some way, etc.).

The various embodiments described herein thus represent a technical improvement to conventional methods for dynamically enforcing cleaning protocols. Using the techniques described herein, an embodiment may receive an indication that an activity session has ended. An embodiment may then determine whether one or more user contact portions of the device were cleaned and, responsive to determining that they were not, an embodiment may perform a sanitary enforcement action (e.g., notify a user, initiate a system lock down, restrict device component use, etc.). Such a method may better ensure that devices remain sanitary and clean as they are shared between users.

As will be appreciated by one skilled in the art, various aspects may be embodied as a system, method or device program product. Accordingly, aspects may take the form of an entirely hardware embodiment or an embodiment including software that may all generally be referred to herein as a "circuit," "module" or "system." Furthermore, aspects may take the form of a device program product embodied in one or more device readable medium(s) having device readable program code embodied therewith.

It should be noted that the various functions described herein may be implemented using instructions stored on a device readable storage medium such as a non-signal storage device that are executed by a processor. A storage device may be, for example, a system, apparatus, or device (e.g., an electronic, magnetic, optical, electromagnetic, infrared, or semiconductor system, apparatus, or device) or any suitable combination of the foregoing. More specific examples of a storage device/medium include the following: a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a storage device is not a signal and "non-transitory" includes all media except signal media.

Program code embodied on a storage medium may be transmitted using any appropriate medium, including but not limited to wireless, wireline, optical fiber cable, RF, et cetera, or any suitable combination of the foregoing.

Program code for carrying out operations may be written in any combination of one or more programming languages. The program code may execute entirely on a single device, partly on a single device, as a stand-alone software package, partly on single device and partly on another device, or entirely on the other device. In some cases, the devices may be connected through any type of connection or network, including a local area network (LAN) or a wide area network (WAN), or the connection may be made through other devices (for example, through the Internet using an Internet Service Provider), through wireless connections, e.g., near-field communication, or through a hard wire connection, such as over a USB connection.

Example embodiments are described herein with reference to the figures, which illustrate example methods, devices and program products according to various example embodiments. It will be understood that the actions and functionality may be implemented at least in part by program instructions. These program instructions may be provided to a processor of a device, a special purpose information handling device, or other programmable data processing device to produce a machine, such that the instructions, which execute via a processor of the device implement the functions/acts specified.

It is worth noting that while specific blocks are used in the figures, and a particular ordering of blocks has been illustrated, these are non-limiting examples. In certain contexts, two or more blocks may be combined, a block may be split into two or more blocks, or certain blocks may be re-ordered or re-organized as appropriate, as the explicit illustrated examples are used only for descriptive purposes and are not to be construed as limiting.

As used herein, the singular "a" and "an" may be construed as including the plural "one or more" unless clearly indicated otherwise.

This disclosure has been presented for purposes of illustration and description but is not intended to be exhaustive or limiting. Many modifications and variations will be apparent to those of ordinary skill in the art. The example embodiments were chosen and described in order to explain principles and practical application, and to enable others of ordinary skill in the art to understand the disclosure for various embodiments with various modifications as are suited to the particular use contemplated.

Thus, although illustrative example embodiments have been described herein with reference to the accompanying figures, it is to be understood that this description is not limiting and that various other changes and modifications may be affected therein by one skilled in the art without departing from the scope or spirit of the disclosure.

What is claimed is:

1. A method, comprising:

receiving, at an information handling device, an indication that an activity session has ended, wherein the receiving the indication comprises identifying, using a sensor, that a user has removed the information handling device;

determining, using the sensor, whether one or more user contact portions of the information handling device were cleaned after the indication was received; and performing, responsive to determining that the one or more user contact portions were not cleaned, a sanitary enforcement action wherein the sensor comprises a proximity sensor;

where the information handling device is a wearable device.

2. The method of claim 1, further comprising providing, subsequent to the identifying and using an output device associated with the information handling device, an alert notification, wherein the alert notification comprises a cleaning reminder.

3. The method of claim 2, wherein the determining comprises determining that the one or more user contact portions of the information handling device were cleaned responsive to identifying a user confirmation input to the cleaning reminder.

4. The method of claim 2, wherein the determining comprises determining that the one or more user contact portions of the information handling device were cleaned responsive to detecting a covering event on the sensor followed by an uncovering event on the sensor;

wherein the sensor is an image sensor.

5. The method of claim 1, further comprising identifying, subsequent to receiving the indication and determining that the one or more user contact portions were not cleaned, that another user desires to initiate a new activity session, wherein the identifying comprises identifying motion of the information handling device via an inertial measurement unit.

6. The method of claim 5, wherein the performing the sanitary enforcement action comprises providing, using an output device associated with the information handling device, an alert notification that the one or more user contact portions of the information handling device are not clean.

7. The method of claim 1, wherein the performing the sanitary enforcement action comprises preventing access to content on the information handling device.

8. The method of claim 1, wherein the performing the sanitary enforcement action comprises restricting adjustment of a body attachment component of the information handling device.

9. The method of claim 1, wherein the performing the sanitary enforcement action comprises recording, in a data store, a negative strike against the user.

10. An information handling device, comprising:

a sensor;

a display screen;

a processor;

a memory device that stores instructions executable by the processor to:

receive an indication that an activity session has ended, wherein the instructions executable by the processor to receive the indication comprise instructions executable by the processor to identify that a user has removed the information handling device;

determine whether one or more user contact portions of the information handling device were cleaned after the indication was received; and perform, responsive to determining that the one or more user contact portions were not cleaned, a sanitary enforcement action;

wherein the sensor comprises a proximity sensor;

wherein the information handling device is a wearable device.

11. The information handling device of claim 10, wherein the instructions are further executable by the processor to provide, subsequent to the identifying and using an output device associated with the information handling device, an alert notification, wherein the alert notification comprises a cleaning reminder.

12. The information handling device of claim 11, wherein the instructions executable by the processor to determine comprise instructions executable by the processor to determine that the one or more user contact portions of the information handling device were cleaned responsive to identifying a user confirmation input to the cleaning reminder.

13. The information handling device of claim 11, wherein the instructions executable by the processor to determine comprise instructions executable by the processor to determine that the one or more user contact portions of the information handling device were cleaned responsive to detecting a covering event on the sensor followed by an uncovering event on the sensor;

wherein the sensor is an image sensor.

14. The information handling device of claim 10, wherein the instructions are further executable by the processor to identify, subsequent to receiving the indication and determining that the one or more user contact portions were not cleaned, that another user desires to initiate a new activity session;

wherein the identifying comprises identifying motion of the information handling device via an inertial measurement unit; and wherein the performing the sanitary enforcement action comprises providing, using an output device associated with the information handling device, an alert notification that the one or more user contact portions of the information handling device are not clean.

15. The information handling device of claim 10, wherein the instructions executable by the processor to perform the sanitary enforcement action comprise instructions executable by the processor to prevent access to content on the information handling device.

16. The information handling device of claim 10, wherein the instructions executable by the processor to perform the sanitary enforcement action comprise instructions executable by the processor to restrict adjustment of a body attachment component of the information handling device.

17. The information handling device of claim 10, wherein the instructions executable by the processor to perform the sanitary enforcement action comprise instructions executable by the processor to record, in a data store, a negative strike against the user.

18. A product, comprising:

a storage device that stores code, the code being executable by a processor and comprising:

code that receives an indication that an activity session has ended on an information handling device, wherein the code that receives the indication comprises codes that identifies that a user has removed the information handling device;

code that determines whether one or more user contact portions of the information handling device were cleaned after the indication was received; and code that performs, responsive to determining that the one or more user contact portions were not cleaned, a sanitary enforcement action;

wherein the information handling device is a wearable device.

* * * * *